United States Patent [19]

Kubota

[11] 4,173,430

[45] Nov. 6, 1979

[54] METHOD OF INJECTING A BACK FILLING INJECTION MATERIAL IN A SHIELD FORMING PROCESS

[75] Inventor: Seizo Kubota, Musashi-Murayama, Japan

[73] Assignee: Sato Kogyo Kabushiki Kaisha, Toyama, Japan

[21] Appl. No.: 854,072

[22] Filed: Nov. 22, 1977

[51] Int. Cl.[2] ..... F04B 15/00; E02D 15/02

[52] U.S. Cl. ..... 417/53; 417/900; 417/431; 198/675; 405/146; 405/147

[58] Field of Search ..... 417/431, 900, 53; 61/84; 198/675

[56] References Cited

U.S. PATENT DOCUMENTS

| | | | |
|---|---|---|---|
| 2,485,208 | 10/1949 | Longenecker | 417/900 |
| 2,606,645 | 8/1952 | Heine | 417/900 |
| 2,995,901 | 8/1961 | Kemper | 61/84 |
| 3,465,685 | 9/1969 | Sherrod | 198/675 |
| 3,667,878 | 6/1972 | Reeve | 417/900 |
| 4,008,012 | 2/1977 | Page | 417/454 |

FOREIGN PATENT DOCUMENTS

| | | | |
|---|---|---|---|
| 1538551 | 7/1968 | France | 61/84 |

*Primary Examiner*—William L. Freeh

*Attorney, Agent, or Firm*—Wenderoth, Lind & Ponack

[57] ABSTRACT

A novel method of injecting a back filling injection material employed in a shield-forming process is described herein. A screw type injection pump with a hopper connected to its intake port is utilized. This pump is rotated in a reverse direction to intake a back filling material into said hopper through a delivery hose connected to its delivery port. The upper limit pressure and a lower limit pressure for the injection pump are set for injection of the back filling material. The injection pump is next rotated in its normal direction to inject the back filling material to a desired location through the delivery hose, and then, after completion of the injection filling of the back filling material, the injection pump is rotated in a reversed direction again to intake water through the delivery hose, thereby washing of the hose and the injection pump can be effected.

1 Claim, 3 Drawing Figures

METHOD OF INJECTING A BACK FILLING INJECTION MATERIAL IN A SHIELD FORMING PROCESS

BACKGROUND AND SUMMARY OF THE INVENTION

The present invention relates to improvements in a method of injecting a back filling injection material in a shield-forming process.

One object of the present invention is to provide an improvd method of injecting a back filling injection material in a shield-forming process in which the injection of the back filling injection material can be achieved automatically and exactly by means of a simple apparatus.

A method of injecting a back filling injection material in a shield-forming process, is presented wherein an injection pump is reversely rotated so that the back filling injection material will fill a hopper connected by a delivery hose to the intake port of the pump. Subsequently, an upper limit pressure and a lower limit pressure for the injection pump are preset for injecting the back filling injection material, and then, the injection pump is rotated in its forward direction to deliver the back filling injection material to the desired location around the shield through the delivery hose. After completion of the injection filling of the back filling injection material at the desired location the, injection pump is again reversely rotated so that to intake it can take in water within a shield through the delivery hose, and thereby effecting washing of the delivery hose and the injection pump.

In the present invention, since the hopper is connected to the intake port of the injection pump, which is preferably a screw pump or the like, the back filling injection material is sucked and charged into the hopper through a delivery hose connected to a delivery port of the injection pump by simply reversing the rotational direction of the pump. Thus charging the back filling injection material into the pump hopper is achieved in a simple manner. Furthermore, since the hopper is directly connected to the injection pump for the back filling injection material, space is saved and a workability is improved.

In addition, since an upper limit and a lower limit for the injection pressure of the back filling injection material delivered by the injection pump is preset depending upon the ground conditions and before the back filling of the injection material is begun, when the injection pressure, during the back filling reaches the upper pressure limit the pump stops when it reaches the lower pressure limit the pump starts; and when the hopper is empty, the pump stops.

Therefore, according to the present invention, damage to the segments, tail seal, and the like caused by excessive injection pressure of the back filling injection material can be prevented and also, since selection of the back filling injection material can be made over a broad range, leakage of the back filling injection material from various portions can be appropriately dealt with. Furthermore, in prior art filling processes often times a pulsating pressure is applied to the ground by the pumping and this results in the ground's destruction when the back filling material is injected thereinto. Whereas, in the process according to the present invention, pulsating pressure is not applied to the ground and, thus, stable injection of a back filling material is achieved.

Once the injection of the back filling injection material around the shield has been completed in the above-described manner according to the present invention, water within the shield is sucked by the pump through its delivery hose by reversely rotating the pump. Thereby the injection pump and the delivery hose are washed in a simple way. Furthermore, since the wash water is collected in the hopper connected to the pump, the time consuming job of cleaning mortar and the like adhering onto the inside of the shield can be spared by merely transporting the hopper containing the water and the pump out of a tunnel. As described above, the present invention provides many advantages.

BRIEF DESCRIPTION OF THE DRAWINGS

The above-mentioned and other objects, features and advantages of the present invention will become more apparent by reference to the following description taken in conjunction with the accompanying drawings, in which.

DETAILED DESCRIPTION OF THE INVENTION

Figure 1:
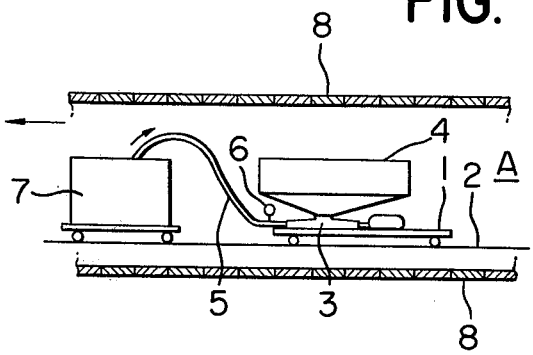
FIG. 1 shows the hopper filling with injection material.

Referring now to the drawings, reference numeral (1) designates a truck (1) is adapted to travel along rails (2) laid within a tunnel bore (A). On the truck (1) is a back filling material injection pump (3) of the screw pump type, and a hopper (4) is connected to an intake port of the pump (3), a delivery hose (5) is connected to the pump's delivery port.

In addition, the pump (3) also has a pressure presetting gauge (6) thereon for presetting the upper pressure limit and a lower pressure limit for the injection pressure during the back filling injection operation.

In these figure, a truck (7) conveys the back filling material which travels along the rails (2). Structural segments inside a previously bore tunnel support the excavated part of the tunnel inside the shield. A tail seal (a) is positioned at the tail porton (B) of a shield type tunneling machine, and seals the space between the outside of the segments 8 forming the tunnel and the newly excavated tunnel portion.

According to the present invention, first the pump (3) is rotated in a reverse directon to withdraw the back filling material from the conveyer truck (7) through the delivery hose (5) into the hopper (4) (FIG. 1).

Figure 2:
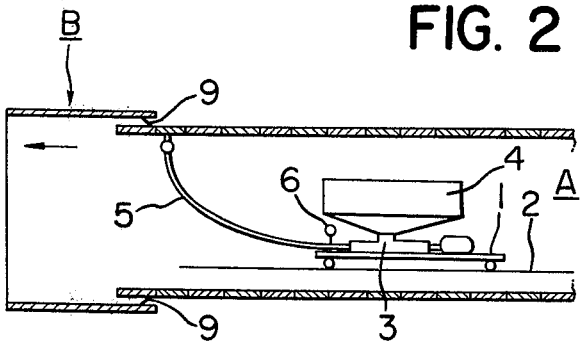
FIG. 2 shows injection material being pumped in the shield-forming process.

Subsequently, and depending upon ground conditions, an upper limit pressure and a lower limit pressure for the pump (3) are set, and the pump (3) is then rotated in its normal direction to cause the back filling injection material within the hopper (4) to be injected to a desired location through the delivery hose (5) (FIG. 2).

Figure 3:
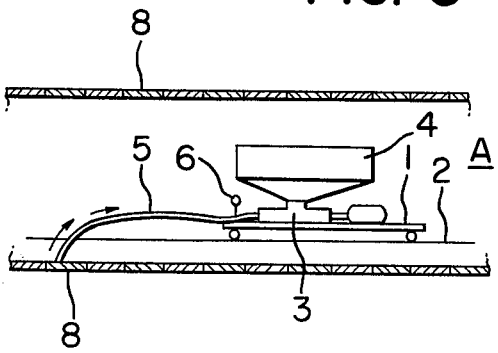
FIG. 3 shows water within the shield being sucked into the hopper.

Once the injection of the back filling material is completed, only water inside the cavity formed by the segments (8) is sucked into the hopper (4) by rotating the pump (3) in a reverse direction. In this manner, the pump (3) and the delivery hose (5) are washed (FIG. 3).

While the present invention has been described above in connection to its preferred embodiment, it is not intended that the present invention should not be limited only to this embodiment, as it is realized that many changes in design can be made without departing from the spirit of the invention.

What is claimed is:

1. A method of injecting a back filling injection material in a shield process, characterized by the steps of reversely rotating an injection pump for a back filling injection material having a hopper connected to its intake port to intake the back filling injection material into said hopper through a delivery hose connected to its delivery port; subsequently presetting an upper limit pressure and a lower limit pressure of said injection pump for injecting said back filling injection material; normally rotating said injection pump to inject said back filling injection material in said hopper to a desired location through said delivery hose; and then, after completion of injection filling of said back filling injection material, reversely rotating said injection pump to intake water within a shield through said deliver hose, thereby effecting washing of said delivery hose and said injection pump.

* * * * *